United States Patent [19]

Hirata

[11] 4,284,205

[45] Aug. 18, 1981

[54] FOLDABLE CUP

[75] Inventor: Isao Hirata, Sagamihara, Japan

[73] Assignee: Tokai Metals Company, Limited, Yokohama, Japan

[21] Appl. No.: 83,317

[22] Filed: Oct. 10, 1979

[30] Foreign Application Priority Data

Oct. 11, 1978 [JP] Japan ..... 53-124173

[51] Int. Cl.[3] ..... B65D 90/04; B65D 5/46

[52] U.S. Cl. ..... 220/418; 229/41 D; 229/52 B; 220/461

[58] Field of Search ..... 220/418, 462, 461, 463; 229/41 C, 41 D, 52 B; 426/411, 115, 122, 123

[56] References Cited

U.S. PATENT DOCUMENTS

| | | | |
|---|---|---|---|
| 1,950,111 | 3/1934 | Heim | 229/41 D |
| 2,293,589 | 8/1942 | Calvert | 220/461 |
| 2,936,068 | 5/1960 | Munkachy | 229/52 B X |
| 3,003,678 | 10/1961 | Chase | 229/52 B X |
| 3,083,889 | 4/1963 | Christensson | 220/418 |
| 3,123,278 | 3/1964 | Morgan et al. | 229/52 B |
| 3,373,917 | 3/1968 | Cox | 220/418 |
| 3,482,758 | 9/1969 | La Pierre et al. | 220/418 X |
| 3,521,807 | 7/1970 | Weisberg | 220/461 X |
| 3,587,837 | 6/1971 | Smith et al. | 229/37 R X |
| 3,896,991 | 7/1975 | Kozlowski et al. | 220/418 X |

FOREIGN PATENT DOCUMENTS

| | | | |
|---|---|---|---|
| 1222728 | 1/1960 | France | 229/41 C |
| 574332 | 3/1958 | Italy | 220/460 |

*Primary Examiner*—Davis T. Moorhead

*Attorney, Agent, or Firm*—Cushman, Darby & Cushman

[57] ABSTRACT

A foldable cup comprises a hollow cylindrical outer shell and a pouch inserted in said outer shell and secured thereto. The outer shell is provided, between its upper and bottom edges, with a plurality of substantially vertical folding lines including two vertical folding lines parallel with each other. By folding outwardly the assembly of the outer shell and the pouch along the two parallel folding lines, the assembly can be folded into a generally flat configuration, whereas by folding the assembly forwardly along all of the folding lines, the assembly can be expanded into a cubic configuration.

6 Claims, 11 Drawing Figures

201
202
210
212
213
230
230'
231
232
233
234
235
204b
211
301
302
310
312

FOLDABLE CUP

BACKGROUND OF THE INVENTION (a) Field of the Invention

The present invention pertains to a convenience cup, and more particularly it concerns a foldable cup which can be folded into a generally flat configuration during storage or transportation and which can be expanded into a cubic configuration when in use to serve as a container for beverage and food.

(b) Description of the Prior Art

Conventional convenience cups may be divided roughly into the following two types, one of which is provided in a generally flat, folded pouch-type configuration, and the other is provided in a cubic form made with a hard paper sheet or sheet-like synthetic resin material. The former which is of a generally flat configuration during non-use period is expanded into an unfolded cubic form to provide a cup-like container during use. The convenience cup of this type is, by itself, very poor in its ability to maintain its cubic configuration after having been unfolded and expanded, and also lacks the ability of standing by itself on a surface of, for example, a table. Thus, it is quite difficult to keep this expanded convenience cup standing by its own force while having some contents placed therein. As such, the user has to endure the inconvenience of continuously supporting this cup so long as it is filled with contents therein. Also, the latter is dispensed with these inconveniences, and the cup has the ability to sustain its own cup-like configuration and to stand by its own force on a table while it is filled with contents therein. However, this type of cup cannot be folded when not used, and accordingly it requires a large storage space which, in turn, leads to an increased expense for storage, transportation and packing.

SUMMARY OF THE INVENTION

It is, therefore, a primary object of the present invention to provide a foldable cup which can be folded into a compact configuration and which is capable of maintaining its standing position when expanded during use.

Another object of the present invention is to provide a foldable cup of the type described above, which can concurrently serve as a packaging container of foodstuff and also as a kind of tableware.

These and other objects as well as the features and the advantages of the present invention will become apparent by reading the following detailed description of the preferred embodiments when taken in conjunction with the accompanying drawings.

BRIEF DESCRIPTION OF THE DRAWINGS

FIGS. 1 to 4 show a first embodiment of the foldable cup of the present invention, in which:

FIG. 1 is a diagrammatic perspective view of this foldable cup in its state of being unfolded and expanded;

FIG. 2 is a diagrammatic perspective view of this foldable cup in its folded state;

FIG. 3 is a diagrammatic extended view of the outer shell; and

FIG. 4 is a diagrammatic extended view of the pouch.

FIGS. 6 to 8 show another embodiment of the foldable cup of the present invention, in which:

FIG. 6 is a diagrammatic perspective view of the foldable cup in its folded state;

FIG. 7 is a diagrammatic extended view of the outer shell; and

FIG. 8 is a diagrammatic extended view of the pouch.

FIGS. 9 and 10 show still another embodiment of the foldable cup of the present invention, in which:

FIG. 9 is a diagrammatic perspective view of the foldable cup in its folded state; and FIG. 10 is an extended view of the outer shell.

FIG. 11 is a diagrammatic perspective view showing a further embodiment of the foldable cup of the present invention.

DETAILED DESCRIPTION OF THE PREFERRED EMBODIMENTS

Figures 1, 2, 3:
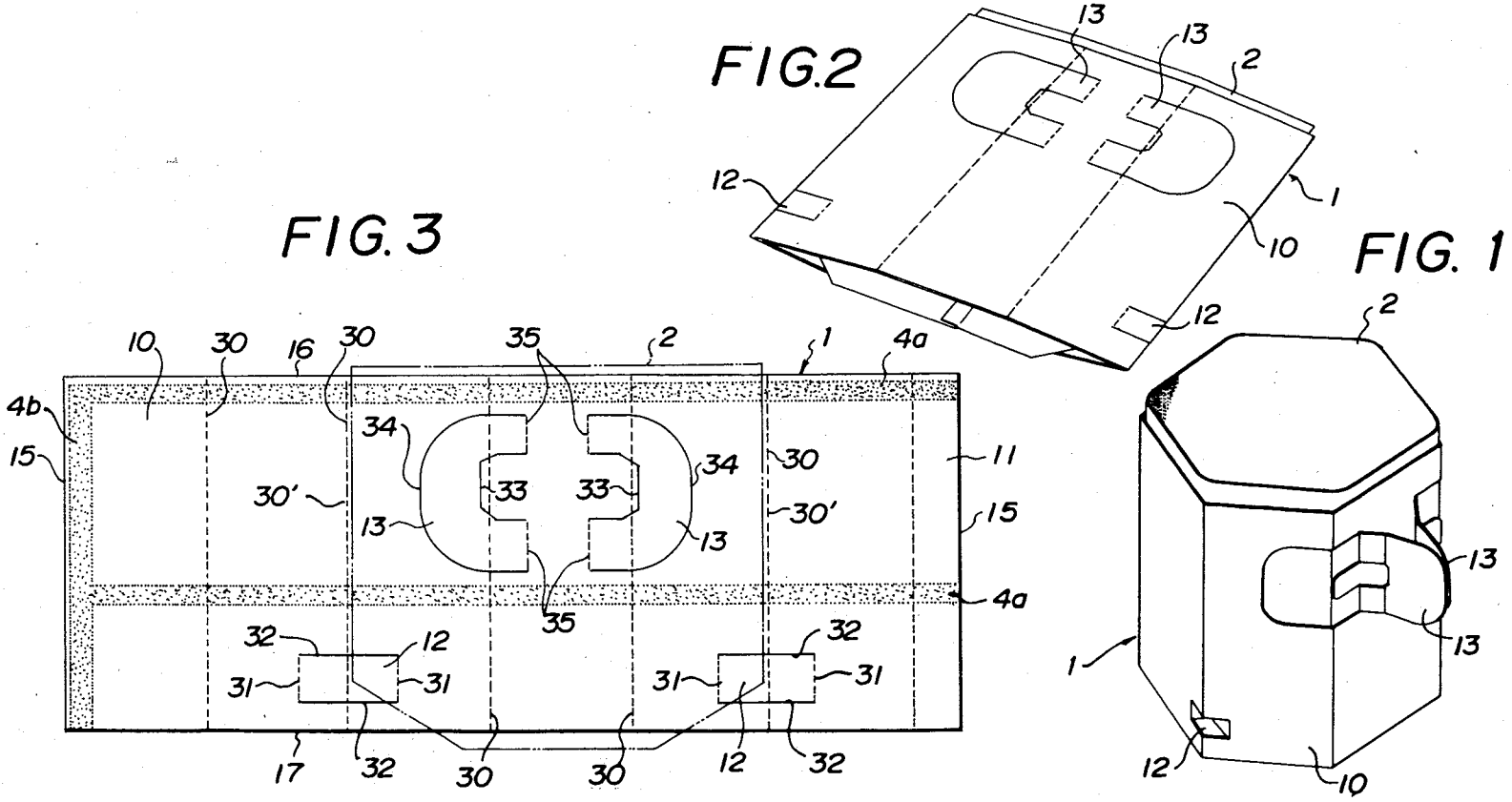

Referring to FIGS. 1 through 4, reference numeral 1 represents an outer shell, and numeral 2 represents a pouch. The shell 1 is formed by folding a rectangular oblong plate-like sheet into two portions and by bonding the opposing side edge portions 15 together. The pouch 2 is snugly fit into this outer shell 1 and is secured to the inner surface of the shell 1. The outer shell 1 is provided with a plurality of vertical folding lines 30 and 30' which are in parallel with the opposing side edges of this shell, and also provided with at least two parallel substantially horizontal cuts 32 and 32 which cross said vertical folding lines and also provided with vertical folding lines 31 and 31 which connect the terminal ends of these cuts together. The foldable cup according to the present invention is operated in such manner that, simply by folding the outer shell 1 only at the two parallel folding lines 30' and 30' toward the outside of the shell, i.e. forming a convex angle, both the outer shell 1 and the pouch 2 are jointly folded into a generally flat configuration, and also that, contrariwise, by simply folding the outer shell 1 at each folding lines 30 and 30' toward the outside of the shell, both the outer shell 1 and the pouch 2 are jointly released from their folded flat configuration into an expanded cubic configuration, as will be explained in further detail below.

As shown in FIG. 3, the outer shell 1 is made with a rectangular plate-like sheet of paper or a blank 10 provided with six (6) vertical folding lines 30 which extend in parallel with the opposing two side edge lines 15 and 15 of this blank 10 and which connect both the top and the bottom edge lines 16 and 17 of the blank 10 together. The blank 10 is provided also with a vertically extending glue-application marginal portion 11 located along one side edge of the rectangular blank 10 in parallel with this side edge line 15. The blank 10 is provided further with two vertical folding lines 31 and 31, forming a pair, and another pair of such folding lines 31 and 31, all of which are in parallel with the respective side edge lines 15 and 15 of the blank, and which also are positioned at both sides of each of the second vertical folding lines 30' and 30', among said six vertical folding lines, as counted from the extreme right and left vertical folding lines. The blank 10 is also provided with horizontally extending spaced two cuts 32 and 32, forming a pair, which are in parallel with the top and the bottom edge lines of the blank 10 and which engage, at their ends, the respective ends of said vertical folding lines 31 and 31 which form the pairs. These paired horizontal cuts 32 and 32 are formed at two locations in the blank 10, as shown in FIG. 3. Each of the pairs of vertical folding lines 31 and 31 and their associated pairs of horizontal cuts 32 and 32 constitute a stopper 12, so that the blank 10 has two such stoppers 12 and 12. The blank 10 is provided further, in the upper portion thereof and between the two stoppers 12 and 12, with a pair of substantially symmetrically disposed C-shaped inner cuts 33 and 33 and another pair of substantially symmetrically disposed C-shaped outer cuts 34 and 34. Both of these latter cuts 34 and 34 have a size larger than that of said inner C-chaped cuts 33 and 33. Two vertically extending folding lines 35 and 35 connect the end edges of one set of outer and inner C-shaped cuts 34 and 33, and another such vertical folding lines 35 and 35 connect the end edges of the other set of outer and inner C-shaped cuts 34 and 33, which set being disposed to oppose said one set of cuts. Those portions of the blank 10 which are left between the respective pairs of outer cuts 34 and inner cuts 33 and which are defined by the vertical folding lines 35 and 35 of the respective pairs constitute a pair of grip handles 13 and 13. The blank 10 is provided further with spaced, substantially horizontally extending two adhesive stripes 4*a* and 4*a* which are parallel with the top and the bottom edge lines 16 and 17 at such positions as will sandwich the gripping handles therebetween. Furthermore, a vertical adhesive stripe 4*b* is provided on that side edge portion 15 opposing the glue-application marginal portion 11 of the blank 10.

Figure 4:
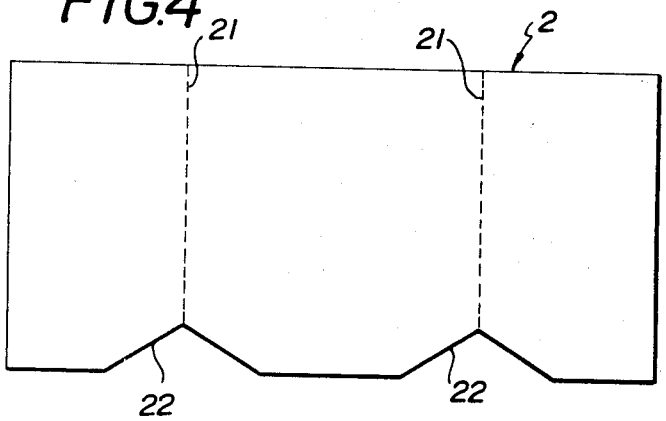

On the other hand, as shown in FIG. 4, the pouch 2 is made with a rectangular oblong sheet of an aluminum foil laminated on one side thereof with a synthetic resin, so that this sheet has both water-proofness and resistivity to water. This sheet 2 is provided with two vertical folding lines 21 and 21 which are parallel with the vertical side edge lines of this sheet 2. Triangular cut-outs 22 and 22 are formed along the bottom edge of the sheet 2 in such manner that the respective apexes of these triangular shapes 22 and 22 are positioned exactly on the lower ends of the vertical folding lines 21 and 21. The resulting sheet 2 is folded, with the synthetic resin-carrying surface lying on the inner side, along the vertical folding lines 21 and 21, and the extreme vertical side edges are bonded together, and then the bottom edges of the sheet 2 is bonded together to provide a sealed bottom portion of a pouch 2. As a matter of course, this pouch has an open upper edge.

This pouch 2, then, is placed on the extended blank 10 at such position as indicated by two-dotts chain lines in FIG. 3. Thereafter, the blank 10 is folded inwardly along the above-said second folding lines 30' and 30', and the glue-application vertical marginal portion 11 is superposed onto the adhesive vertical stripe 4*b* of the other side edge portion 15 of the blank 10 to establish the bonding between these two vertical side edge portions of the blank. The horizontal upper marginal portions of the pouch 2 and similar portions of the blank 10 are pressed against each other so that the upper marginal portions of the pouch 2 are bonded onto the corresponding upper marginal portions of the blank 10 by the upper adhesive stripe 4*a* which is provided on the blank 10. As a result, the assembly of both the pouch 2 and the blank 10 is provided in a generally flat configuration. In case it is intended to use this flat assembly of foldable cup to provide an open container, it is only necessary to fold at each of the vertical folding lines of the outer shell 1 in such manner that the apex defined by each vertical folding line protrudes outwardly to provide a convex angle. This may be achieved by, for example, supporting the assembly with the user's fingers while nipping the two folding lines 30' and 30' between two fingers, and then by closing these two fingers toward each other, or alternatively by inserting a couple of fingers into the pouch 2 from the top opening thereof and then by pressing the inner walls of the pouch in opposite directions by these two fingers, i.e. in a direction in which the two fingers are parted farther away from each other. As a result, the outer shell 1 is expanded into a hexagonal shape, and at the same time therewith, the pouch 2 is opened. During such operation, the pouch 2 per se is firmly held by its outer shell 1. Thus, even when a liquid is poured into this pouch 2, the cup as a whole will not fall down, but it can keep its erect position by itself.

Furthermore, the respective stoppers 12 and 12 may be bent and folded inwardly along the vertical folding lines 30, 31 and 31. By doing so, the holdability of a cup-shape and the self-standing ability of the outer shell 1 will be enhanced further. Thus, the cup as a whole is able to keep standing on a table with stability. Also, the grip handles 13 may be set up from the surface of the outer shell by bending them outwardly along the vertical folding lines 35. Thus, they can be utilized as the grip handles of the cup. These grip handles 13 and 13 will provide a great convenience when a hot beverage is poured into this expanded cup.

Figure 5:
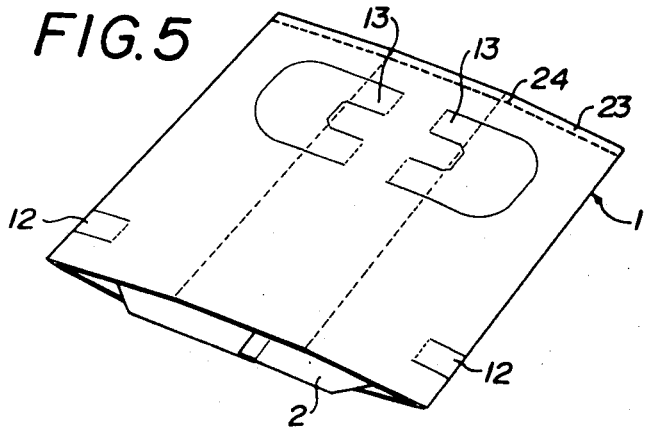
FIG. 5 is a diagrammatic perspective view showing a modification of the foldable cup shown in FIGS. 1 through 4.

Such foldable cup of the present invention having a structure as described above is useful not only as a mere cup, but also as a packageable container of some kinds of instantaneously prepared foods. In this latter case, this foldable cup functions as a cup also. For example, a frozen and dried powder food, such as instant coffee, instant soup and powder of imitation fruit juice, is placed into the pouch 2 in the state of the cup being folded substantially flat as shown in FIG. 5. The open top edge portions of the pouch 2 are then bonded together to seal the open end, and also the resulting upper end edge portions of the outer surface of the pouch 2 are bonded to the corresponding upper end edge portions of the inner surface of the outer shell 1 to provide a ribbon-like bonded portion 23. A cut line 24 is formed along the lower boundary of this ribbon-like bonded portion 23. In use, this ribbon-like bonded portion 23 is torn apart along the cut line 24. Thereafter, the substantially flat cup is expanded in a manner as stated above, and hot water is poured into the resulting cup. Thus, the contents contained inside the cup are ready for use.

As stated, the foldable cup according to this embodiment is such that the upper end edges of the pouch are sealed. Thus, this foldable cup is hygienic and is desirable from the viewpoint of sanitation.

As stated, the foldable cup according to the present invention functions as a tableware and concurrently as a packageable container of an instant food which is dry and may be in a powder form. Thus, in the state of this foldable cup being functioning as a packaging container, it is substantially flat and does not require much space, so that the cost for storage and transportation can be reduced greatly.

Figure 8:
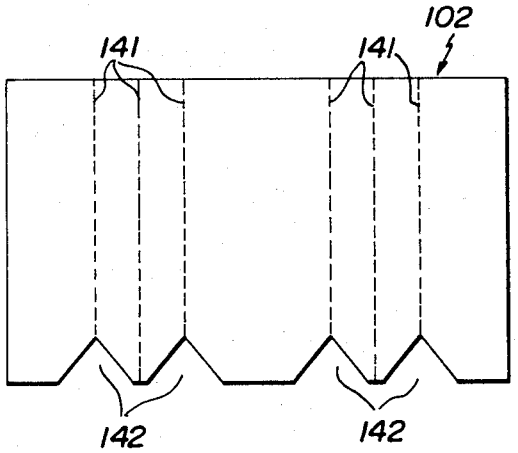
Figure 6:
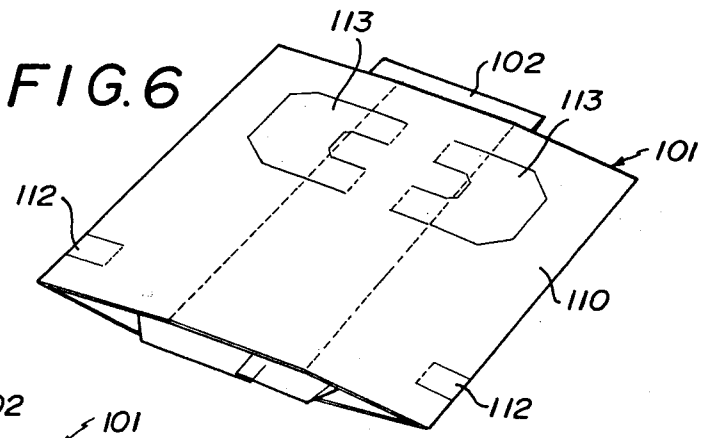
Figure 7:
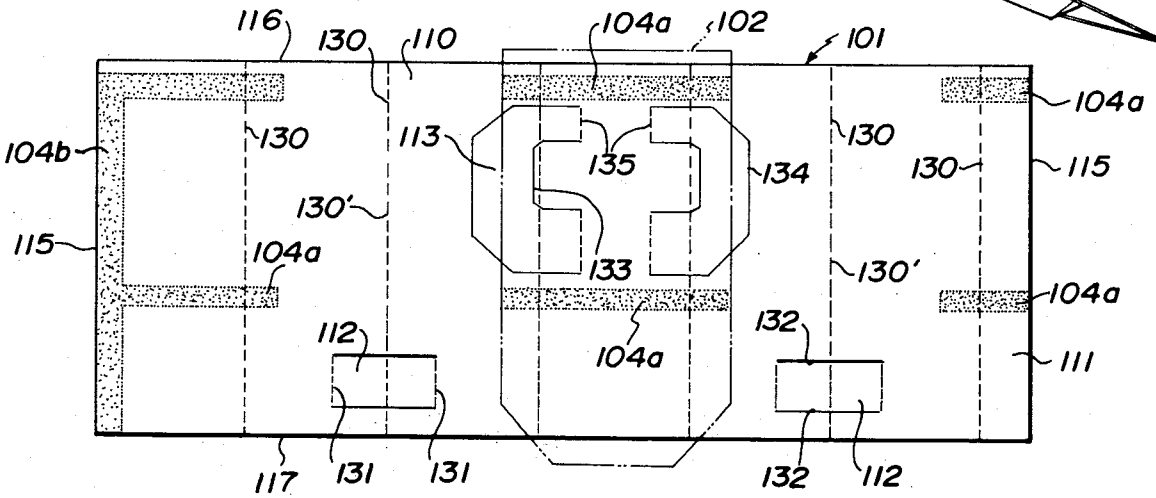

FIGS. 6 through 8 show another embodiment of the foldable cup of the present invention. The foldable cup of this embodiment differs from the preceding embodiment in the structure of the pouch 102 and the manner of bonding of this pouch 102 to the blank 110 of the outer shell 101. As will be noted from FIG. 8, the pouch 102 is made with a rectangular sheet made of a material having both resistance to water and water-proofness, and is provided with two pairs of three vertical folding lines 141 which are parallel with the vertical side edge lines of the sheet. This sheet 102 of the pouch is provided along its bottom edge with two pairs of triangular cut-outs 142, each pair being comprised of two such cut-outs. The respective apexes of the two triangular shapes in each pair are arranged to be positioned exactly on the two outer vertical folding lines of each pair of three vertical folding lines 141. When it is intended to form a pouch from this sheet 102, the sheet is folded along the central vertical line 141 among the three vertical folding lines 141 in each pair in such manner that the central folding line projects inwardly, whereas the sheet is folded outwardly along the adjacent two vertical folding lines 141 and 141 which are provided on both sides of the central folding line 141. Both vertical marginal side end portions of this sheet 102 are superposed one upon another, and these portions are bonded together by an adhesive agent. Then, the edges of the two triangular shapes in each pair are bonded together, followed by bonding the bottom edges of the sheet 102 to provide a sealed bottom of the pouch 102. With respect to the bonding between the pouch 102 and the blank 110 of the outer shell 101, the horizontally extending adhesive stripes provided on the blank 110 of the outer shell 101 are locally omitted in order to allow the folded two side edge portions of the pouch 102 to expand freely. More particularly, at the central upper marginal portion and also at a substantially middle portion of the inner surface of the blank 110 of the outer shell 101, there are provided a length of horizontal adhesive stripe **104*a* and another length of horizontal adhesive stripe 104*a*, respectively, as shown in FIG. 7, so as to correspond to the width of the pouch 102. An upper horizontal and a lower horizontal adhesive stripe 104*a* and 104*a* are provided on the vertical glue-application portion 111 and also on the opposing vertical side edge portion 115 of the same surface of the blank 110 of the outer shell 101. Under such state, the aforesaid pouch 102 is placed on said surface of the blank 110 of the outer shell sheet 101 at such location and in such manner as shown in FIG. 7. Then, the blank 110 is folded at the respective second folding lines 130' and 130', respectively, as counted from the extreme right and left vertical folding lines 130 and 130 to bond together the side edge portion 115 and the glue-application portion 111 of the blank 110. Then, the pouch 102 is bonded to the inner surface of the blank 110 of the outer shell sheet 101**.

Figures 9, 10, 11:
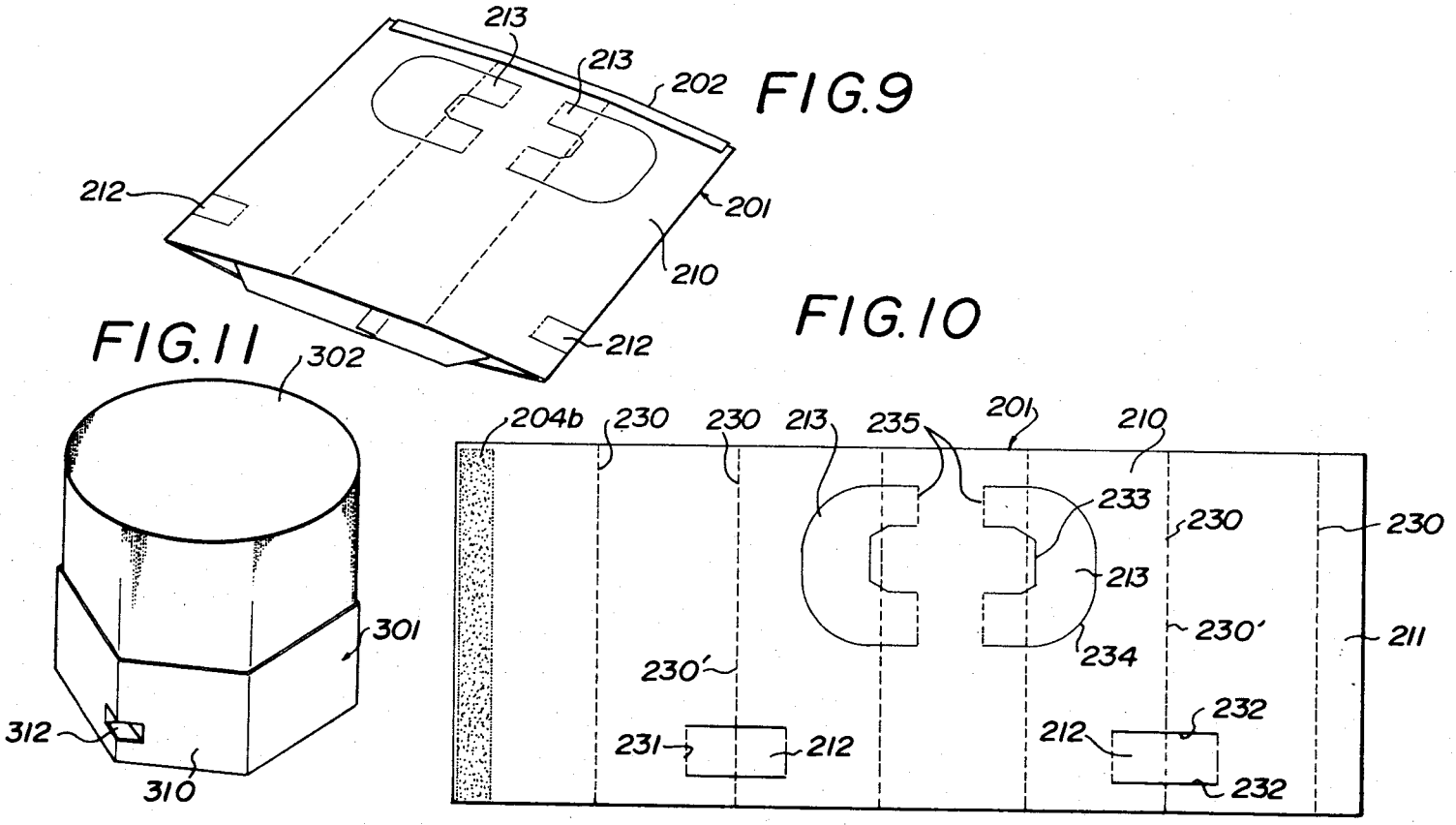

FIGS. 9 and 10 show a still further embodiment of the foldable cup of the present invention.

In this embodiment, a vertical adhesive stripe **204*b* is applied onto only that vertical side edge portion of the blank 210 of the outer shell sheet 201 which is located opposite to the vertical glue-application portion 211. A pouch 202 is placed on the surface of the blank 210 on which the adhesive agent has been applied, in such manner and at such position as indicated in FIG. 10. Then, the blank 210 of the outer shell sheet 201 is folded at the respective second vertical folding lines 230' and 230' in much the same way as in the preceding embodiment, and thus the vertical side edge portion is bonded to the vertical glue-application portion 211 of the blank 210 of this outer sheet 201. Along with this, the open top edge portion of the pouch 202 is folded outwardly over the top edge of the outer shell 201 to extend for a small distance toward the outer surface of the shell sheet 201. With this arrangement of the foldable cup of this instant embodiment, the pouch 202 is not bonded to the outer shell 201, but the pouch can be secured to the outer shell by means of the folded upper edge portion of the pouch. When the folded outer shell 201 is expanded into a hollow cylindrical cup form, the pouch 202 having its open top edge portion folded over the top edges of the outer shell 201** will also be expanded and opened accordingly.

In this instant embodiment, by providing the vertical adhesive stripe **204*b* so as to have its width a little larger than the width of the vertical glue-application portion 211 on the blank 210 of the outer shell 201, the surplus portion of the adhesive stripe 204*b* extending beyond the width of the glue-application portion 211, when the adhesive stripe-carrying side edge portion of the blank 210 is bonded onto its glue-application portion 211, will adhere to the surface of the pouch 202, so that the pouch 202 will not slip off the outer shell 201 in which the pouch 202** is accomodated.

FIG. 11 shows a further embodiment of the foldable cup of the present invention. In this embodiment, the outer shell 301 has its height or the vertical length reduced to about one half of that of those outer shells shown in the respective preceding embodiments. By so reducing the vertical length of the outer shell, the cost of material can be reduced accordingly. It should be understood that, in this embodiment, it is preferred that the pouch 302 be made with a sheet material having a substantial hardness.

As will be apparent from the foregoing statement, the foldable cup or container of the present invention has a greatly reduced volume when folded, as compared with conventional cubic-type convenience cups. Accordingly, it is possible to save the costs required for storage, transportation, packing and like purposes. In case the outer shell of the foldable cup of the present invention is expanded, it is possible to keep the cup standing on a surface of, for example, a table while a beverage or food is filled in the pouch of this cup.

Description has been made of embodiments of the present invention in which the foldable cup has a generally hexagonal configuration by means of six vertical folding lines. Most preferred outer configuration of the foldable cup is an exact hexagonal configuration which is obtained by forming equally spaced six vertical folding lines on the outer shell sheet. It should be understood, however, that the configuration of the foldable cup of the present invention is not limited thereto, but various modifications and changes, such as polygonal configurations, may be introduced without departing from the spirit and scope of the present invention.

What is claimed is:

1. A foldable cup, comprising: a hollow outer shell formed by folding a rectangular plate-like sheet upon itself and by bonding the two side edges thereof together, and a pouch inserted in said outer shell and secured thereto, said outer shell being provided with a plurality of substantially vertical folding lines parallel with two side edges of the outer shell, and further provided with at least one pair of substantially horizontal parallel cuts crossing one of said vertical folding lines and with a pair of substantially vertical lines connecting the respective ends of these cuts for defining at least one stopper which, upon expanding the foldable cup, may be folded inwardly along said vertical folding line for enhancing the holdability of a cup shape and the self-standing ability of the outer shell.

2. A foldable cup according to claim 1, in which: said pouch has a portion sealed near its open end to provide a sealed upper end portion of the pouch, and this sealed upper end portion is bonded to said outer shell to provide a bonded portion, and in which: the outer shell is provided, at said bonded portion, with a cutting line adapted for cutting this bonded portion apart from the remaining portion of the foldable cup.

3. A foldable cup according to claim 1 or 2, in which: said plurality of substantially vertical folding lines are six in number.

4. A foldable cup according to claim 1 or 2, in which: said pouch is secured to said outer shell by an adhesive agent applied to an inner surface of said outer shell.

5. A foldable cup according to claim 1, in which: said pouch is secured to said outer shell by a portion of the pouch near its open upper end, said a portion being folded outwardly over upper edges of said outer shell onto the outer surface of this outer shell.

6. A foldable cup according to claim 1 or 2, further comprising: a first substantially C-shaped cut and a second substantially C-shaped cut which is located on the outer side of said first C-shaped cut and larger in size than that of said first C-chaped cut, both of these first and second C-shaped cuts forming a pair and being provided on the outer shell, said pair of first and second C-shaped cuts having their terminal ends connected by folding lines formed on said outer shell, there being provided correspondingly another pair of similar C-shaped cuts formed on the outer shell and connected, at their terminal ends, by similar folding lines, said another pair of C-shaped cuts and their associated folding lines being provided symmetrically on the outer shell.

* * * * *